US007303196B2

(12) United States Patent
Harper

(10) Patent No.: US 7,303,196 B2
(45) Date of Patent: Dec. 4, 2007

(54) LEVEL STEER IN-LINE SKATE

(76) Inventor: Arthur Harper, 1075 N. Tustin, Orange, CA (US) 92865

( * ) Notice: Subject to any disclaimer, the term of this patent is extended or adjusted under 35 U.S.C. 154(b) by 0 days.

(21) Appl. No.: 11/259,684

(22) Filed: Oct. 27, 2005

(65) Prior Publication Data

US 2007/0096409 A1 May 3, 2007

(51) Int. Cl.
*A63C 1/24* (2006.01)
*A63C 17/00* (2006.01)

(52) U.S. Cl. ..... 280/11.28; 280/11.27; 280/11.19

(58) Field of Classification Search ..... 280/11.27, 280/11.28, 11.25, 11.221, 11.233, 11.224, 280/11.231, 11.19, 87.042
See application file for complete search history.

(56) References Cited

U.S. PATENT DOCUMENTS 208,508 A * 10/1878 Bowen ..... 280/11.27
1,703,936 A * 3/1929 Jervoise ..... 280/178
2,122,311 A * 6/1938 Campbell ..... 280/11.28
2,557,331 A * 6/1951 Wintercorn ..... 280/11.28
2,719,724 A * 10/1955 Lundgren ..... 280/11.223
5,183,277 A * 2/1993 Tang ..... 280/11.28
5,441,287 A * 8/1995 Tang ..... 280/11.28
5,979,916 A * 11/1999 Gatel et al. ..... 280/11.224
6,098,997 A * 8/2000 Cheng ..... 280/11.28
6,926,290 B2 * 8/2005 Tang ..... 280/11.27

* cited by examiner

*Primary Examiner*—Hau Phan

(57) ABSTRACT

A steering assembly for an in-line roller skate having at least two wheels and at least one horizontally rotatable wheel mechanism for steering. Attached under the sole of a boot, are two planar members that coincide to the general shape and size of the sole. The members are flatwise horizontally, centrally rotatable to each other. A linkage mechanism allows horizontal rotational motion to be transmitted from the sole fixed drive planar member, to a front rotatable wheel mechanism mounted on the underside of the base planar member. Characteristic of ice skates, a level oriented rotational motion of the foot steers the direction of the skate. The horizontal boot-to-wheel rotary motion, provides solid, variable steering for controlled turns, while all wheels are in contact with the riding surface. When the skate is not in contact with the riding surface, a flexible alignment mechanism is then free to restore the steering assembly to the straight line motion of the skate. An optional locking mechanism can be employed for conventional in-line skating.

6 Claims, 7 Drawing Sheets

FIG. 6
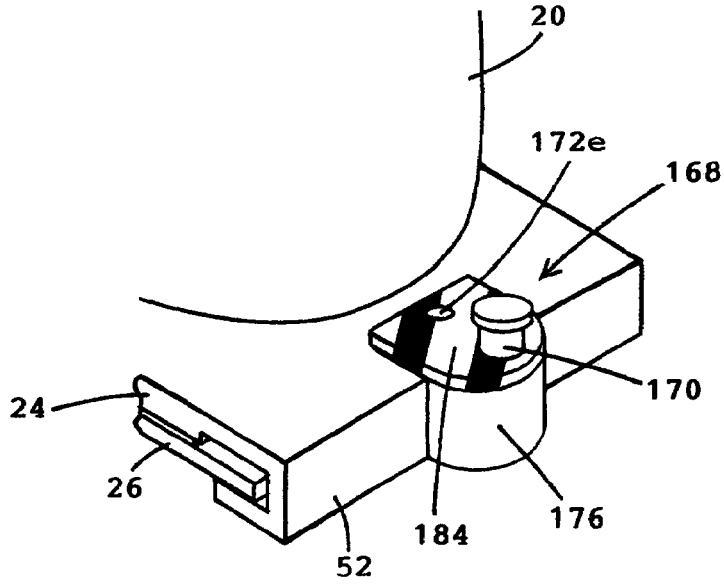
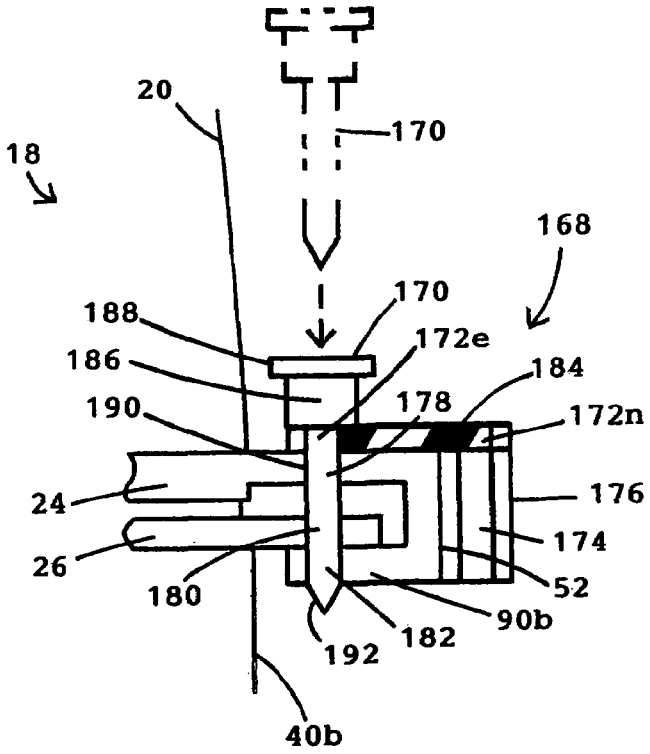
FIG. 7

LEVEL STEER IN-LINE SKATE

BACKGROUND OF THE INVENTION

This invention relates to roller skates and in particular to a steering assembly for an in-line roller skate with a foot controlled, rotatable wheel mechanism.

Conventional in-line skates utilize at least two wheels aligned one behind the other and positioned to only rotate along a single plane perpendicular to their axes of rotation. While functioning with some maneuverability, these skates are often awkward when turning, especially at high speeds.

Similarly, rocker skates disclose a center wheel or centrally located pair of wheels whose axes of rotation is below that of the front and rear wheels, to produce a pivoting or rocking action that facilitates turning and maneuvering. This orientation is inherently less stable than a skate with all axles on a common plane.

Steerable wheel systems for turning in-line skates, have attempted to solve this long felt problem. They often include a flexible mechanism to realign a steerable wheel. Some describe castor wheel assemblies and castor skate designs.

Such a skate is shown in U.S. Pat. No. 2,719,724 (to Lundgren, 1955). The user turns by pivoting the skate off vertical, which can influence a pair of synchronized castor wheels in the desired direction to aid steering. However, such clumsy, weight shifting maneuvers for steering, increase the difficulty in skating.

Another in-line skate with a steerable wheel system, employs a non-castor, rotatable wheel mechanism. Although useful in part, the wheel mechanism is controlled by a tilting foot motion.

Such a skate is disclosed in U.S. Pat. No. 1,703,936 (to Jervoise, 1929) wherein the foot pivots sideways in a see-saw fashion on a base plate, actuating synchronized rotatable wheel mechanisms for steering. Once again, skating is more difficult because pivoting the foot off vertical for steering, requires awkward, weight shifting maneuvers in order to implement the steering gear.

SUMMARY OF THE INVENTION

In accordance with the present invention a steerable in-line skate comprises a drive planar member, a base planar member, a rotatable wheel mechanism, an interconnecting steering linkage mechanism between the drive member and the rotatable wheel mechanism, a self-adjusting alignment mechanism and an optional locking mechanism for conventional in-line skating. Characteristic of ice skates, the user's foot moves in a firm, horizontally rotatable motion to maximize vertical balance for control in steering an in-line skate.

One aspect of the present invention is to provide a user friendly, steerable in-line skate, that is actuated by a horizontal rotation of the user's foot similar to ice skates and while all wheels are in contact with the riding surface.

Another aspect of the invention is to have the planar sides of the planar members remain solidly horizontal and parallel to each other when rotating, whether one or both skates are in a vertical or inclined orientation.

Another aspect of the invention is to have the axis of rotation of the planar members centrally located to the natural rotation of the user's foot, for more balanced steering.

Another aspect of the invention is to provide at least one rotatable wheel mechanism for steering, which is horizontally rotatably mounted to the underside of the base member, with the center of it's in-line wheel on the vertical axis of rotation of the wheel mechanism.

Another aspect of the invention is to provide a positive linkage mechanism, so that the drive member can concurrently transmit its horizontal rotational motion to the rotatable wheel mechanism, for the desired degree of horizontal rotational motion, clockwise or counterclockwise.

Another aspect of the invention is to provide a skate that can bring the rotatable components in alignment with a flexible band, while minimizing oscillations.

Also, another aspect of the invention is to provide a level oriented, steerable skate with maneuvering capabilities that can maximize deceleration by alternating slalom turns, especially downhill as used by every skier.

A further aspect of the invention is to accomplish skills in braking, while all wheels of a skate engage the road surface.

Yet another aspect of the invention is to provide a safer skate that can be used in roller hockey, indoor and outdoor roller rinks, skate parks, to make U-turns, airborne landing turns, regular corner turns and sharp turns at high speed.

Still another aspect of the invention is to provide a skate that can easily turn on rough, soiled or high friction surfaces, hence minimizing excessive heat buildup and wheel wear to the ground.

In addition, another aspect of the invention is to provide an optional locking mechanism, whenever conventional in-line skating is desired by the user.

Lastly, another aspect of the invention is to provide an in-line skate with a steering assembly which produces a turning mobility in skating that is easy and fun to use.

Other aspects will become apparent from the specifications and drawings.

BRIEF DESCRIPTION OF THE DRAWINGS

FIG. 6 is an enlarged perspective view of the invention, showing the locking mechanism unused and stored;

FIG. 7 is an enlarged rear cross-sectional side view of the invention, taken along line 29-29 in FIG. 2, showing the locking mechanism in use;

DETAILED DESCRIPTION OF THE INVENTION

Figure 1:
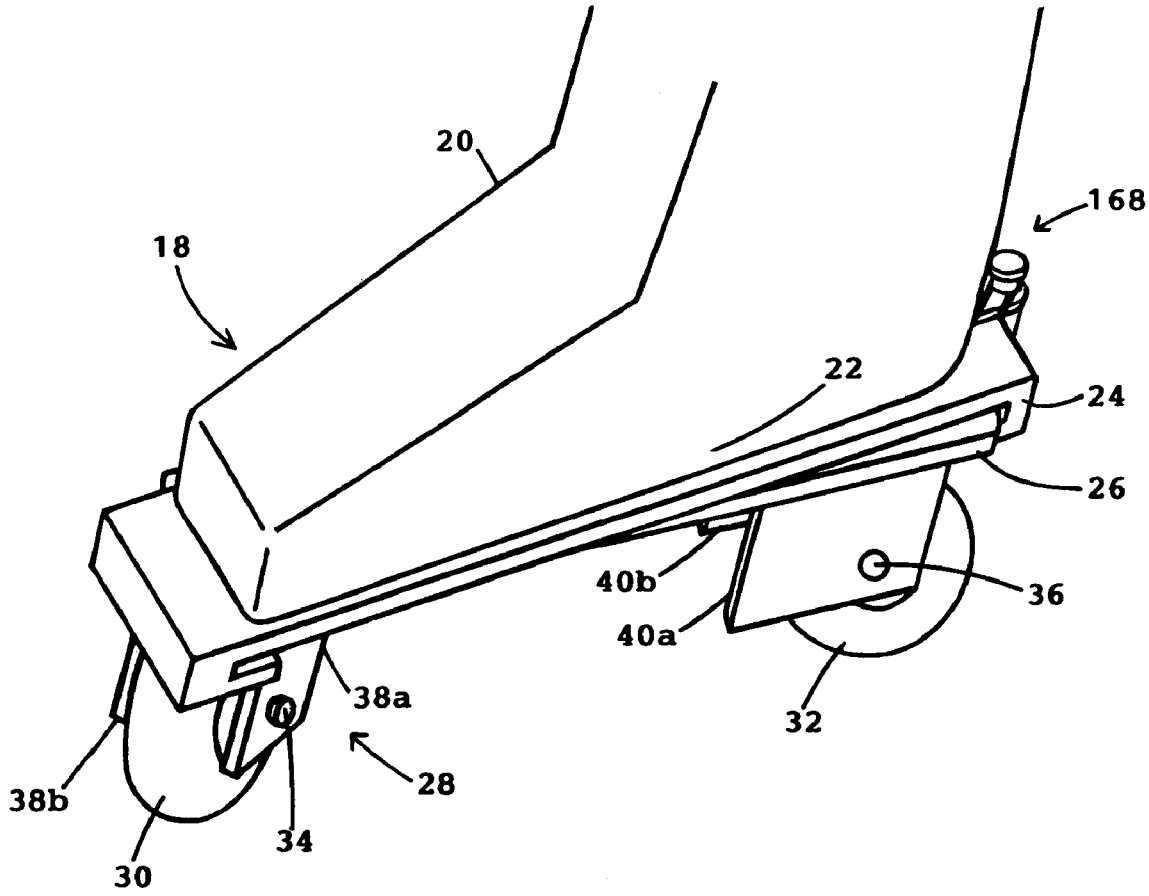
FIG. 1 is a perspective view of the invention, showing the optional locking mechanism.
Figure 2:
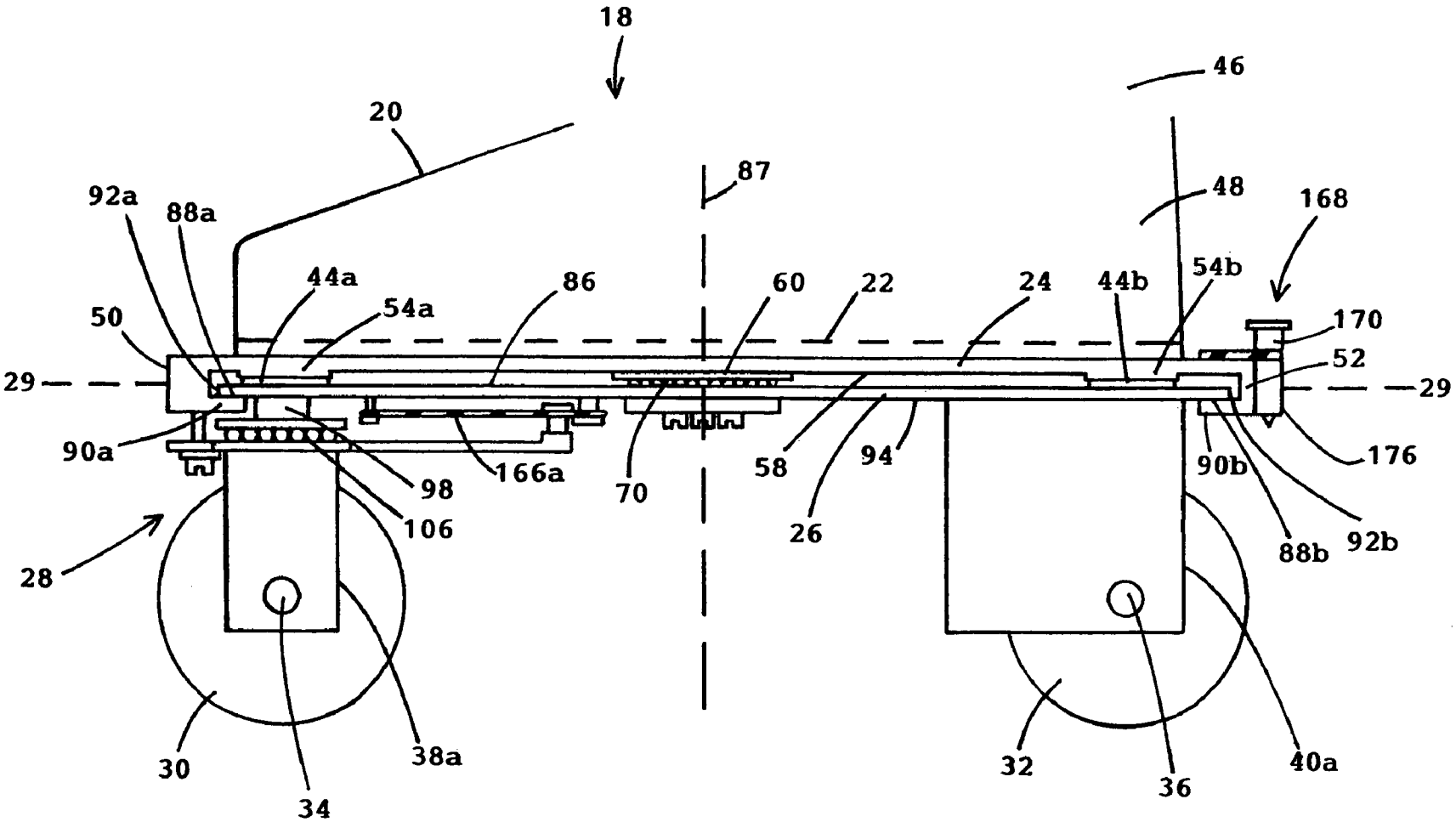
FIG. 2 is a side view of the invention, showing the optional locking mechanism.

Referring to FIGS. 1 and 2, an in-line skate 18 having a steering assembly of the present invention includes, a boot 20, a sole 22 and two rectangular planar members 24 and 26 that relate to the general size and shape of the sole 22.

There are two equal sized conventional in-line wheels 30 32 mounted on axles 34 and 36, as typically provided for the market today. The axles 34 and 36 are supported in struts 38*a* and 38*b*, 40*a* and 40*b* and secured by identical nuts 42*a* and 42*b* of FIG. 8A. The front wheel 30 and the drive member 24 of the skate 18 shown in FIG. 1, are partially turned to the left of the user to represent the steering assembly in operation. In straight line motion, the wheels 30 and 32 are aligned along a single plane of rotation perpendicular to the central lengthwise axes of the members 24 and 26. The rear wheel 32 is non-steerably mounted between the parallel struts 40*a* and 40*b*, that integrally extend perpendicular from the base member 26.

Figure 3:
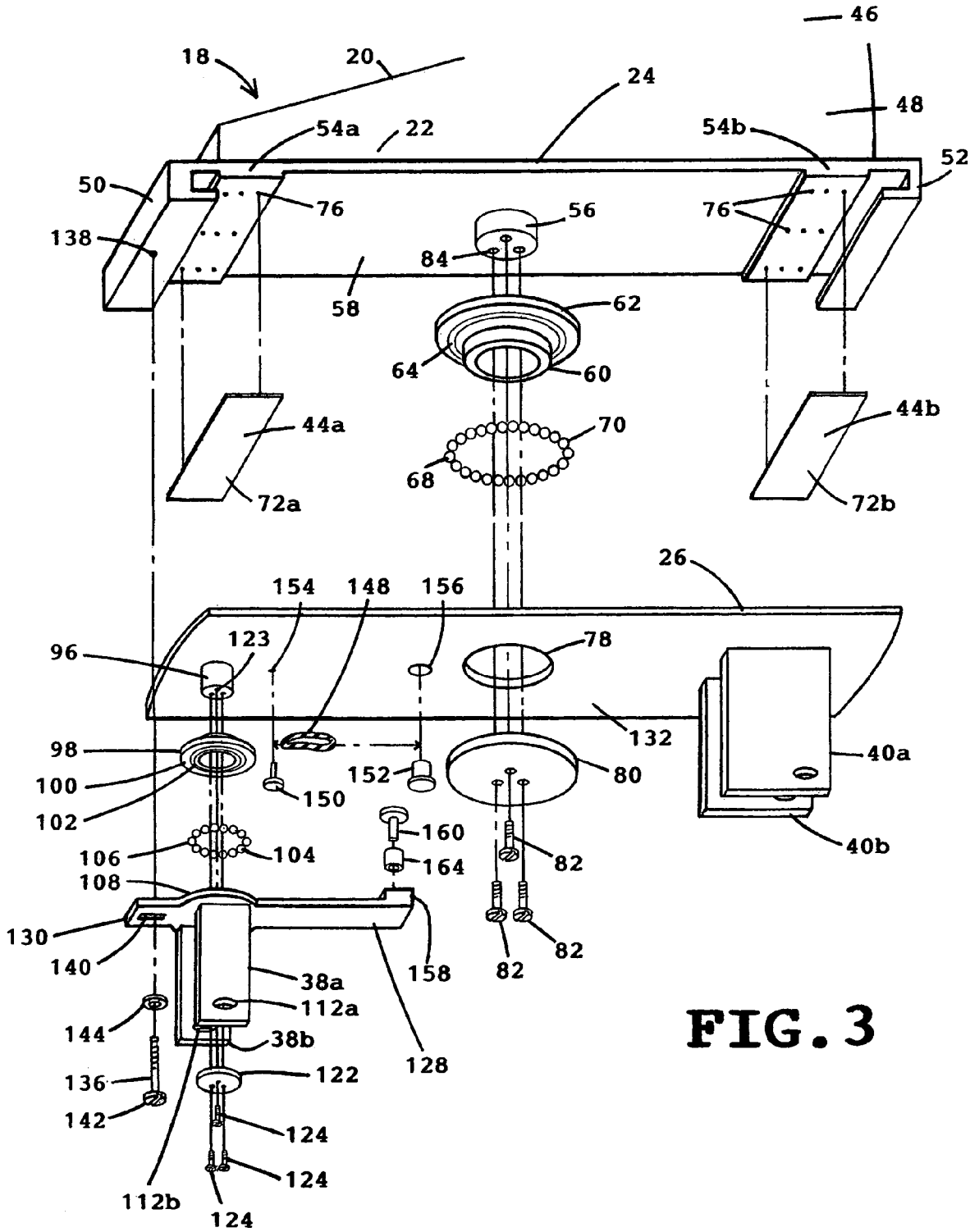
FIG. 3 is an exploded perspective view of the invention.

Referring to FIGS. 2 and 3, the upper portion 46 of the boot 20 is incorporated into the lower portion 48 by such conventional methods as rivets, stitching and adhesive (not shown). The upper portion 46 is constructed of softer plastic material than the lower portion 48, for flexibility and comfort. The planar drive member 24 is flatwise horizontally, integrally attached to the sole 22.

As best shown in FIG. 3, front and rear brackets 50 and 52, a pair of equal sized spacers 54*a* and 54*b* and a centrally positioned axle shaft 56, are all integrally attached to the underside 58 of the drive member 24. The lower portion 48 of the boot 20 and drive member 24, are formed into one solid unit made of rigid plastic material, such as glass reinforced nylon.

Also shown in FIG. 3, the shaft 56 includes a pressure fitted metal bushing 60, to aid smooth rotation of the base member 26. The bushing 60 has a integrally connected, top disk-shaped flange 62 with a circular groove 64 that is sized to support anti-friction, steel ball bearings 68 for a bearing race 70. A pair of thin identical panels 44*a* and 44*b* are attached on the spacers 54*a* and 54*b*, with a smooth surface 72*a* and 72*b* on one side for slidability. As only shown on the opposite side of the front panel 44*a* of FIG. 4, identical studs 74 are pressure fitted into stud holes 76 as both panels 44*a* and 44*b* are secured with adhesive.

Shown in FIG. 3, the base member 26 has a base hole 78 that is sized to be smoothly, rotatably mounted on the shaft bushing 60. The base hole 78 is centered along the central lengthwise axis of the base 26. The base member 26 is secured to the shaft 56 of the drive member 24 by a large shaft cover 80, with three identical metal screws 82 in shaft holes 84. The base 26 and cover 80 are made of rigid aircraft aluminum.

As shown in FIG. 2, the cover 80 and brackets 50 and 52 serve to hold the base member 26 firmly in place on the drive member 24, to assure steady horizontal rotational motion in either direction of the drive member 24. The central vertical axis of the shaft 56 illustrated by line 87, is centrally positioned between the wheel axles 34 and 36, and extends perpendicularly from the central lengthwise axis of the drive member 24. The members 24 and 26 rotate coaxially and in vertical alignment. The central vertical position of the shaft axis 87, corresponds to the natural, centrally located, vertical axis of rotation of the user's foot; thereby maximizing maneuverability and balance in turning.

Shown in FIG. 2, the panels 44*a* and 44*b* and the ball bearing race 70 are sandwiched between the members 24 and 26, allowing metal-to-metal contact for slidable support against the top planar surface 86 of the base member 26. The interior surfaces 88*a* and 88*b* of the bracket flanges 90*a* and 90*b* are smooth to facilitate slidability, while firmly supporting the edges 92*a* and 92*b* of the base member 26. The panels 44*a* and 44*b*, bracket flanges 90*a* and 90*b*, and bearing race 70, assure horizontal rotational motion by maintaining the flatwise parallel position between the supportively wide planar members 24 and 26, even when the skate is being turned and inclined by the user from an upright orientation.

Hence, the planar members 24 and 26 of this invention are always smoothly, horizontally rotatably spaced at a predetermined distance from each other, clockwise or counterclockwise and whether a skate is on or off a riding surface.

During the manufacturing, the initial coupling of the members 24 and 26 can be accomplished by positioning the base member 26 on the shaft bushing 60 lengthwise transverse to the drive member 24, then simply rotate the base member 26 horizontally into the brackets 50 and 52 of the drive member 24.

Included in FIG. 2, a rotatable wheel mechanism 28 for steering the skate 18, is mounted horizontally rotatable to the frontal underside 94 of the base member 26, permitting the wheel 30 to rotate on its axle 34 while the axle 34 is allowed of rotate horizontally to the base 26.

Figure 4:
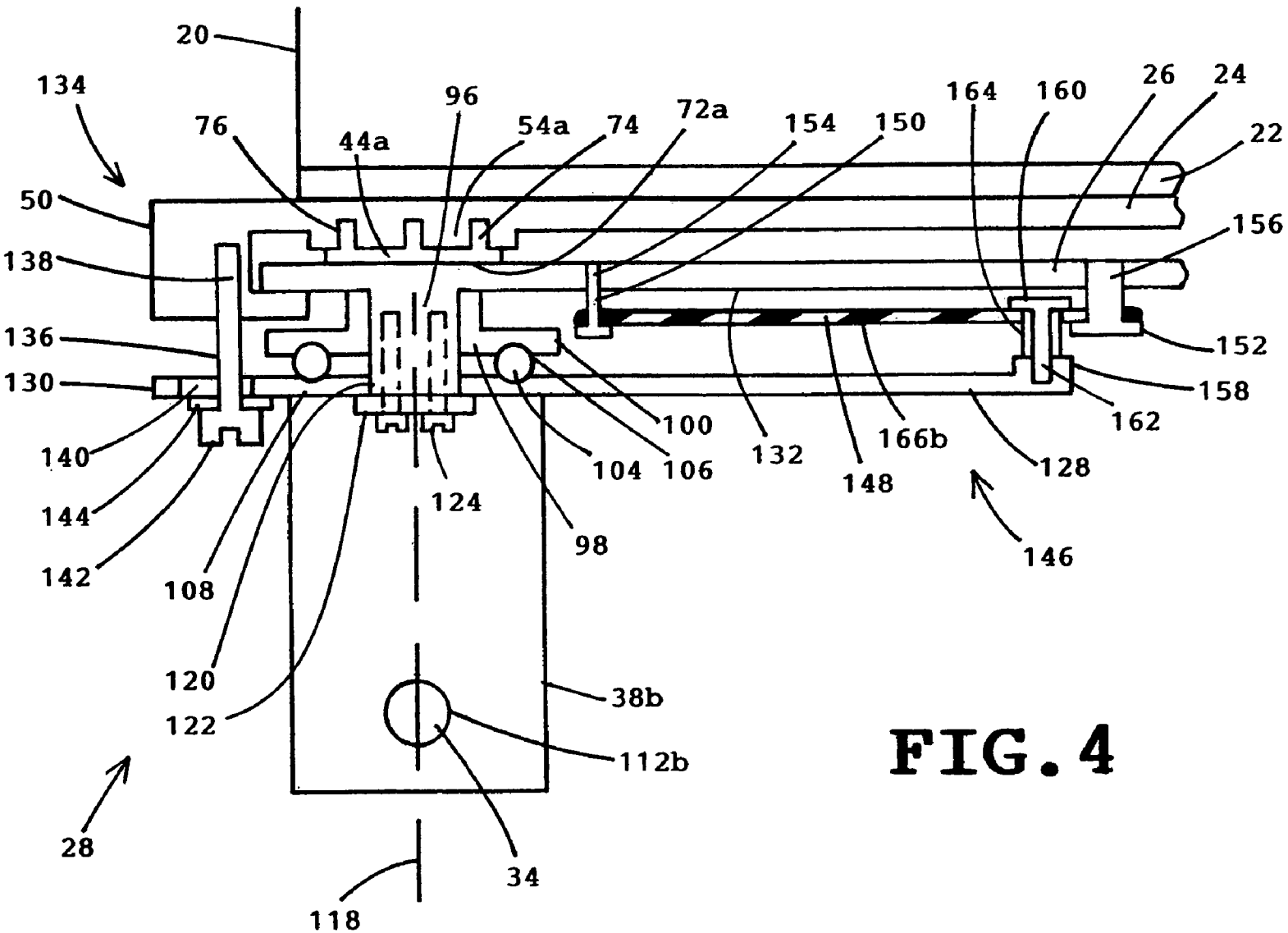
FIG. 4 is an enlarged frontal cross-sectional side view of the invention, taken along line 29-29 in FIG. 2, and which lies on the central lengthwise axis of the planar members.

Referring to FIGS. 3 and 4, a post 96 integrally extends perpendicularly from the base 26 and is centered along the base member's 26 central lengthwise axis. A metal post bushing 98 is pressure fitted on the post 96 and has a integrally connected, bottom disk-shaped flange 100. The flange 100 has a circular groove 102 sized to support anti-friction, steel ball bearings 104 for a ball bearing race 106. The flange 100 is positioned horizontally remote from the underside 94 of the base 26 and acts as a platform for the rotatable wheel mechanism 28.

Also pertaining to FIGS. 3 and 4, the rotatable wheel mechanism 28 is made of rigid aircraft aluminum and includes a planar table 108 from which the same sized struts 38*a* and 38*b* are integrally connected. The struts 38*a* and 38*b* extend perpendicular from the underside of the table 108 and are parallel and opposite each other, with strut holes 112*a* and 112*b* coaxially aligned and horizontal to the base 26.

The rotatable wheel mechanism 28 is coaxially aligned to rotate along the center axis 118 of the post 96, which intersects the diameter of the axle 34, as shown in FIG. 4. Also referring to FIGS. 3 and 4, the planar table 108 has a centrally positioned table hole 120, that is sized to be rotatably mounted on the post 96. The ball bearing race 106 is sandwiched between the flange 100 and the planar table 108. The table 108 is firmly secured to the post 96 by an aircraft aluminum post cover 122 and three identical metal screws 124 in post holes 123. The bearing race 106 allows the wheel mechanism 28 to smoothly rotate horizontally, against the flange 100.

A control arm 128 and a drive arm 130 are also illustrated in FIGS. 3 and 4; each are board shaped, integral extensions from the opposite edges of the planar table 108. The planar sides of the arms 128 and 130 are horizontal to the underside 132 of the base member 26 and lengthwise centered on the diameter of the planar table 108, that crosses the axis of rotation of the rotatable wheel mechanism 28. When a skate is in straight line motion, the arms 128 and 130 are lengthwise centered along the central lengthwise axis of the base member 26.

As best shown in FIG. 4, the drive member 24 is interconnected to the rotatable wheel mechanism 28 by a linkage mechanism 134. A drive screw 136 is positioned along the central lengthwise axis of the drive member 24 and extends perpendicularly from a screw hole 138 formed in the front bracket 50.

Referring to FIGS. 3 and 4, a non-threaded portion of the drive screw 136 is inserted through a slot 140. The slot 140 is centered along the central lengthwise axis of the drive arm 130. The screw 136 is sized for smooth back and forth sliding motion within the slot 140. The screw 136 remains perpendicular as the rotatable wheel mechanism 28 is horizontally rotated by the drive member 24; thus allowing even horizontal force to be applied in the slot 140. An addition, a screw head 142 and washer 144 on the drive screw 136, help support the drive arm 130.

The screw-in-slot design represents a simple sliding mechanism, which facilitates workability, especially when the slot 140 is soiled. As the drive member 24 is allowed to rotate horizontally, clockwise or counterclockwise, the drive screw 136 concurrently transmits the horizontal rotational motion from the drive member 24 to the drive arm 130, which thereby horizontally rotates the rotatable wheel mechanism 28. The user horizontally rotates the foot to actuate the wheel mechanism 28, for solid boot-to-wheel, variable steering. The wheel mechanism 28 turns and steers an in-line skate, similar to a scooter or bicycle.

As best shown in FIG. 4, the present invention includes an alignment mechanism 146. A small outer pillar 150 and a large inner pillar 152 are pressure fitted and welded in holes 154 and 156 on the underside 132 of the base member 26. The pillars 150 and 152 extend perpendicularly and are centered along the central lengthwise axis of the base 26. A ridge 158 is formed at the remote end of the control arm 128. A metal pin 160 is pressure fitted into a hole 162 and centered in the ridge 158. The pin 160 secures a freely rotatable, metal cylindrical coupling 164. A flexible band 148 made of elastic material such as rubber or synthetic rubber, is tightly suspended around the two pillars 150 and 152. The coupling 164 has the same diameter as the large pillar 152.

Figure 5A:
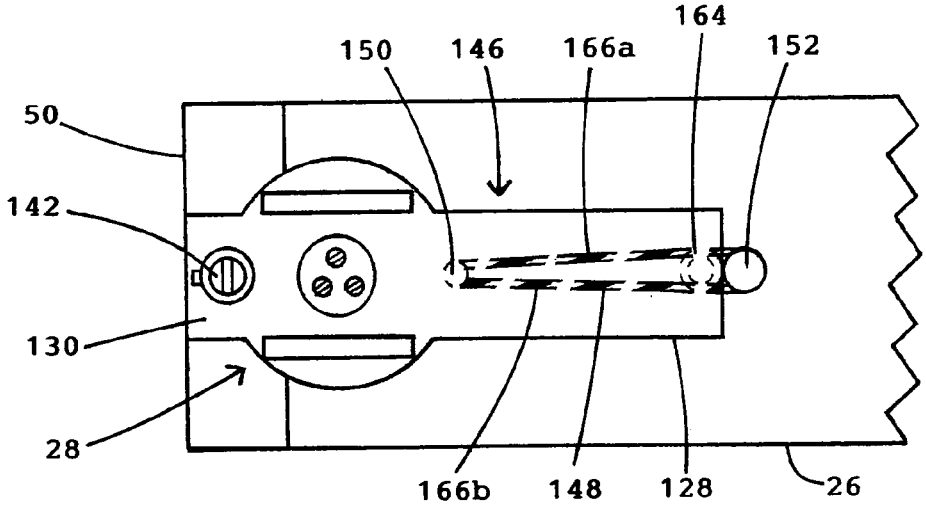
FIGS. 5A and 5B show front bottom views of the invention, with the alignment mechanism at a straight direction FIG. 5A, and with the alignment mechanism after being steered to the left of the user FIG. 5B.

Pertaining to FIG. 5A, the coupling 164 and pillars 150 and 152 are positioned firmly between two strands 166*a* and 166*b* formed by the band 148. Different bands of varying flexibility can be interchangeable and made available to the user. The band 148 also helps moderate foot rotation, for more even steering. When the rotatable wheel mechanism 28 is in alignment, the control arm 128 is lengthwise centered along the central lengthwise axis of the base member 26, allowing for straight line motion of the skate.

Figure 5B:
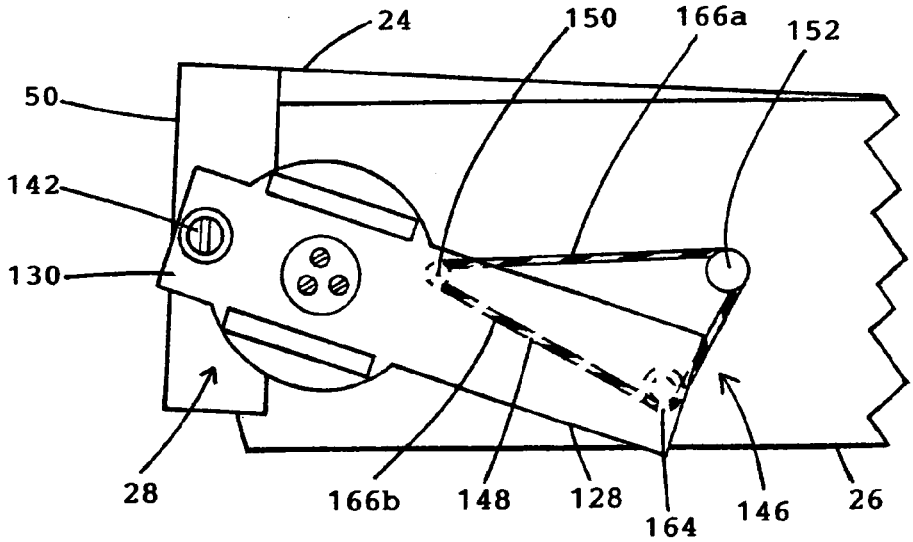

Pertaining to FIG. 5B, the rotatable wheel mechanism 28 is shown turned to the left of the user. If the skate is then lifted off the riding surface, the flexible band 148 will apply transverse force to the control arm 128, to return and hold the rotatable wheel mechanism 28 in alignment. Thus restoring the straight line mode of the skate.

The coupling 164 is placed relatively close to the large pillar 152, to minimize transverse vibration as the control arm 128 returns from its bias position. The close proximity of the pillar 152 and coupling 164, increases hold and acts as a dampening mechanism.

Hence, the skate of the present invention incorporates two alignment methods. 1. The drive member 24 is rotatably employed by the user's foot for turning and aligning the rotatable wheel mechanism 28, when the skate is on the ground. 2. When the skate is off the ground and the steering assembly is in a rotated orientation, the steering assembly then becomes freely rotatable for self-adjustment and alignment by the flexible band 148.

As shown in FIGS. 2 and 6, when using the present invention for steering, a locking mechanism 168 is not engaged. A rigid metal peg 170 is stored on a shelf 176 extending from the rear bracket 52. Hence, the steering assembly is unlocked and free to move.

As shown in FIG. 7, the user is provided with the option of skating in the conventional manner by employing the locking mechanism 168. When the steering assembly is locked, the peg 170 prevents rotational movement of the drive and base members 24 and 26. The central lengthwise axes of the members 24 and 26 remain parallel to each other, as the skate is fixed in a straight line directional mode.

To lock the steering assembly, as also shown in FIG. 7, the rigid metal peg 170 is removed from holes 172*n* and 174 in the shelf 176 and inserted into holes 172*e*, 178, 180 and 182. During the locking engagement process, the members 24 and 26 must be positioned in the straight line directional mode, so that the holes 172*e*, 178, 180 and 182 are aligned. The peg 170 is easily moved up or down, by using two or more fingers pressed against the lip portion 188 of the finger handle 186. A rod portion 190 of the peg 170 is sized for smooth sliding engagement through the holes 172*e*, 178, 180 and 182. A beveled tip 192 at the distal end of the rod 190, facilitates easy entry. The bracket flange 90*b* helps hold the rod 190 in rigid vertical position on the drive member 24, thereby keeping the base member 26 steady. A rubber pad 184 is attached to the surfaces of the drive member 24 and shelf 176 with adhesive. The pad holes 172*e* and 172*n* are sized small enough to tightly surround the rod 190 with sufficient friction to firmly secure the peg 170, in either the locked or unlocked position, until pulled out by the user.

Thus, the optional locking mechanism 168 can be employed quickly and easily, whenever conventional in-line skating is desired. The locking and unlocking procedure can even be done while the user is coasting in straight line motion.

Figure 8A:
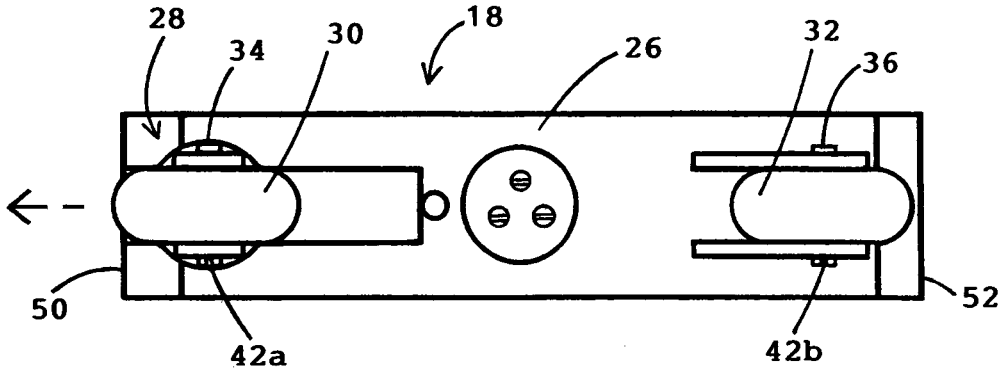
FIGS. 8A and 8B show bottom views of the invention, with the skate in straight direction FIG. 8A, and after being steered to the left of the user FIG. 8B.
Figure 8B:
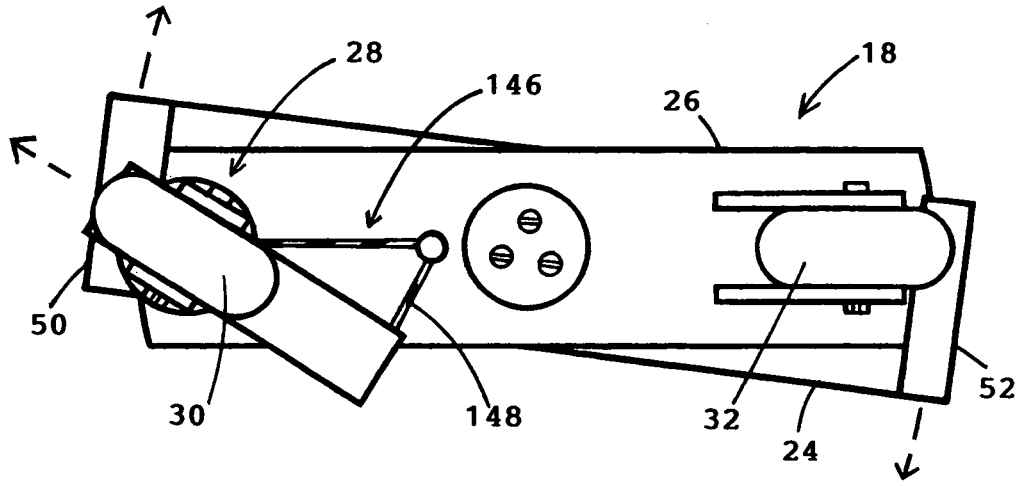

To operate the steering assembly of the present invention for one or both skates, all wheels maintain engagement to the road surface. As shown in FIG. 8A, when the skate 18 is in straight line motion or a vertical coasting mode to the riding surface, the wheels 30 and 32 are positioned to rotate on the same plane perpendicular along the central lengthwise axis of the base 26. Referring to FIG. 8B, the base member 26 remains stationary as a level oriented twist-turn of the foot rotates the drive member 24 horizontally for the desired direction of motion of the skate 18, characteristic of ice skates. The wheel 30 rotates laterally away from the central lengthwise axis of the base 26.

When a skate is in a turning motion, the front wheel and the user's foot turn together right or left, providing a more natural turning experience. Progressively more lateral or horizontal rotation of the foot, will directly result in a greater rate of turn of the wheel. Accordingly, the user will incline his body and the skate from a vertical position, to the desired angle for counterbalancing the centrifugal force of the turn.

For additional turning force, the user can firstly waist-twist the upper body in the general direction of the turn. Then followed by the foot and leg, as the knee and foot typically move together in the same direction of a turn.

The rotatable wheel mechanism can steer a skate's direction of motion forward or backward, similar to the front wheel of a bicycle or scooter. A turnable wheel reduces friction and wear on the wheels, even with very soft rubber wheels.

When accelerating by the user's foot power, one skate pushes back for thrust while the other skate supports the user and steers along the ground. During lifting a skate off the ground for back thrust or forward placement, the flexible alignment mechanism will self-adjust the steering assembly and quickly return the rotatable wheel mechanism to a straight line mode before the skate is placed back on the ground.

Skates incorporating the present invention can brake by using the steering assembly. When in a coasting mode and all wheels are in contact with the road surface, braking can be accomplished by having one skate positioned forward, as one or both skates turn inward or alternate in and out, while the user remains in the same direction of motion.

Braking can also be accomplished by having one or both skates change the direction of the user, by doing sharp quick turns, zigzag turns and U-turns. This reduces the need for a rubber heel brake. Heel brakes require the user to balance on one skate, while awkwardly tilting the other skate for braking.

Slalom turns can easily be made on level or downhill surfaces to aid slowing down, even on high traction, rolling or grassy surfaces. In smooth, level downhill skating, all wheels often remain on the riding surface as propulsion is provided by gravity.

Steep slopes can accelerate the user to an unsafe speed, which sadly has been the cause of bad accidents. Easy to do slalom turns by the disclosed invention, are especially important for controlling downhill speed. The user can vary the degree of slowing power with confidence, by a greater or lesser degree of horizontal foot rotation.

Although the preferred embodiment of the invention has been illustrated and described, other methods of construction and design may be used in applying the teaching described herein. For example, skilled artisans can make the size, shape and materials used in the components of the present invention different, for a particular skating need. They can make the drive member attachable to the sole by screws or rivets. They can make the flange attachable to the drive member by screws. They can made a turntable attachment between the members, in place of the central shaft. They can make the distance of the drive screw from the post vary, either on or extend beyond the bracket. They can make the big pillar magnetic and the control arm longer, to increase the dampening and holding power of the alignment mechanism. They can make the skate with only a rear rotatable wheel mechanism. They can make the present invention adaptable to quad roller skates. They can make the skate longer for ski type downhill skating. They can make the skate with synchronized steerable, front and rear rotatable wheel mechanisms.

The reader is requested to determine the scope of the invention by the appended claims and legal rights thereof, and not by the examples which have been given.

The invention claimed is:

1. A steering assembly for an in-line roller skate with at least a front wheel and a rear wheel, comprising:

a) a sole fixed to a boot;

b) a drive member with a substantially horizontal attachment means to attach said drive member to said sole;

c) a base member with a substantially horizontal rotatable attachment means to rotatably attach said base member to the underside of said drive member and said rotatable attachment means being substantially along the central length axis of said sole;

d) said base member being approximately the length of said sole and having at least said front wheel and said rear wheel of the skate located on the under-side of said base member and substantially along the central length axis of the base;

e) a rotatable wheel mechanism with a substantially horizontal rotatable attachment means to rotatably attach said rotatable wheel mechanism to the underside of at least one end of said base member and substantially along said central length axis of said base;

f) a continuous steerable holding means disposed outward from the central vertical axis of rotation of said rotatable wheel mechanism is provided, to firmly hold said wheel mechanism to said drive member at any horizontally rotated steered position along a predetermined distance of the rotation of said rotatable wheel mechanism, even when said skate is inclined sideways to the riding surface;

g) said rotatable wheel mechanism having a wheel, with the plane of said wheel being located substantially along said central length axis of said base member and an alignment means is provided to align said plane thereof, from a laterally rotated position to a straight central position, when said skate is off the riding surface.

2. The steering assembly of claim 1, wherein said drive member includes a bracket and a horizontal slidable supporting means is provided for supporting said base member in said bracket.

3. The steering assembly of claim 1, wherein said members are horizontally spaced from each other at a predetermined distance and includes a slidable supportive element sandwiched between said members.

4. The steering assembly of claim 1, wherein an optional locking mechanism is provided to lock said members relatively parallel to their central length axes.

5. The steering assembly of claim 1, wherein the members are horizontally rotatable at a centrally positioned axis on said members and said axis being located substantially in the middle of said sole.

6. The steering assembly of claim 1, wherein said assembly having said holding means is adaptable to lengthwise ski-type in-line roller skates.

* * * * *